US005837412A

United States Patent [19]

Suzuki et al.

[11] Patent Number: 5,837,412

[45] Date of Patent: Nov. 17, 1998

[54] ELECTROPHOTOGRAPHIC PHOTOSENSITIVE MEMBER, AND PROCESS CARTRIDGE AND ELECTROPHOTOGRAPHIC APPARATUS UTILIZING THE SAME

[75] Inventors: Koichi Suzuki, Shizuoka-ken; Toshihiro Kikuchi; Kazushige Nakamura, both of Yokohama; Tetsuro Kanemaru, Tokyo; Kouichi Nakata, Numazu, all of Japan

[73] Assignee: Canon Kabushiki Kaisha, Tokyo, Japan

[21] Appl. No.: 908,377

[22] Filed: Aug. 7, 1997

[30] Foreign Application Priority Data

Aug. 8, 1996 [JP] Japan ..... 8-209502

[51] Int. Cl.[6] ..... G03G 5/047

[52] U.S. Cl. ..... 430/59; 430/73; 430/77

[58] Field of Search ..... 430/73, 77, 83, 430/59

[56] References Cited

U.S. PATENT DOCUMENTS

| | | | |
|---|---|---|---|
| 4,853,308 | 8/1989 | Ong. et al. | 430/59 |
| 5,049,464 | 9/1991 | Kanemaru et al. | 430/59 |
| 5,098,809 | 3/1992 | Kikuchi et al. | 430/73 |
| 5,126,223 | 6/1992 | Kikuchi et al. | 430/59 |
| 5,238,765 | 8/1993 | Senoo et al. | 430/73 |
| 5,380,613 | 1/1995 | Ueda et al. | 430/59 |
| 5,415,962 | 5/1995 | Kanemaru et al. | 430/59 |
| 5,422,210 | 6/1995 | Maruyama et al. | 430/59 |
| 5,486,439 | 1/1996 | Sakakibara et al. | 430/59 |
| 5,510,218 | 4/1996 | Nakata et al. | 430/59 |
| 5,702,855 | 12/1997 | Ikegami et al. | 430/83 |

FOREIGN PATENT DOCUMENTS

| | | |
|---|---|---|
| 0504794 | 9/1992 | European Pat. Off. . |
| 0686878 | 12/1995 | European Pat. Off. . |
| 61-239248 | 10/1986 | Japan . |
| 62-67094 | 3/1987 | Japan . |
| 62-208054 | 9/1987 | Japan . |
| 62-265666 | 11/1987 | Japan . |
| 63-50848 | 3/1988 | Japan . |
| 63-52150 | 3/1988 | Japan . |
| 64-44451 | 2/1989 | Japan . |
| 64-44944 | 2/1989 | Japan . |
| 2-71274 | 3/1990 | Japan . |
| 3-128973 | 5/1991 | Japan . |
| 3-170941 | 7/1991 | Japan . |
| 3-200790 | 9/1991 | Japan . |
| 4-51248 | 2/1992 | Japan . |
| 5-297613 | 11/1993 | Japan . |

*Primary Examiner*—John Goodrow

*Attorney, Agent, or Firm*—Fitzpatric, Cella, Harper & Scinto

[57] ABSTRACT

An electrophotographic photosensitive member has a support and a photosensitive layer provided thereon. The photosensitive layer contains a hindered phenol compound and a fluorene compound represented by the following formula (1):

(1)

wherein $R_1$, $R_2$, $R_3$ and $R_4$ are each independently substituted or unsubstituted aryl, and $R_5$ and $R_6$ are each independently hydrogen, substituted or unsubstituted alkyl, substituted or unsubstituted aryl, or substituted or unsubstituted aralkyl.

9 Claims, 5 Drawing Sheets

ELECTROPHOTOGRAPHIC PHOTOSENSITIVE MEMBER, AND PROCESS CARTRIDGE AND ELECTROPHOTOGRAPHIC APPARATUS UTILIZING THE SAME

BACKGROUND OF THE INVENTION

1. Field of the Invention

The present invention relates to an electrophotographic photosensitive member, and more particularly to an electrophotographic photosensitive member provided with improved electrophotographic characteristics. The present invention also relates to a process cartridge and an electrophotographic apparatus provided with such electrophotographic photosensitive member.

2. Related Background Art

In the electrophotographic photosensitive member, inorganic photoconductive materials, such as selenium, zinc oxide and cadmium sulfide, have widely been used.

In recent years, considering advantages such as higher safety, suitability for mass production and lower cost, the use of organic photoconductive materials have been actively investigated and various electrophotographic photosensitive members utilizing such organic photoconductive materials have been proposed and put to practical use. The recent developments have been principally directed, among such photosensitive members, toward the photosensitive members of laminated structure composed of a charge generating layer containing a charge generating material and a charge transport layer containing a charge transport material.

However, even such laminate-structure photosensitive members are often insufficient in durability, because they exhibit a loss of charging potential or a variation in the potential of a light area after the repetition of the image forming process comprising the steps of charging, exposure, image development, image transfer and charge elimination, thus resulting in image defects such as fogging (or fogged image), or image blur (or unfocused image).

These phenomena are considered to arise, for example, from deterioration by $O_3$, $NO_x$, $SO_x$ etc. generated at the charging and from deterioration by light irradiation. For avoiding such deterioration of the materials, particularly the deterioration by oxidation, it is already known to add certain antioxidants in the photosensitive layer, as disclosed, for example, in Japanese Patent Application Laid-Open Nos. 62-265666, 63-50848, 63-52150, 64-44451, 3-170941, 4-51248 and 5-297613.

However, the addition of such antioxidants is often unable to exhibit the sufficient antioxidation effect or may result in the deterioration of electrophotographic characteristics such as sensitivity or residual potential.

In addition, with a reversal development system which goes with digitization, because primary charging and image transfer charging are opposite to each other in their polarities, the difference in the charging ability depending on the presence or absence of image transfer, what is called a transfer memory phenomenon, is liable to occur, bringing about unevenness in image density.

SUMMARY OF THE INVENTION

An object of the present invention is to provide an electrophotographic photosensitive member which is excellent in the electrophotographic characteristics and in the durability to the repetition of the image forming process.

Another object of the present invention is to provide an electrophotographic photosensitive member which is less associated with the transfer memory phenomenon.

Still another object of the present invention is to provide a process cartridge and an electrophotographic apparatus utilizing such electrophotographic photosensitive member.

The above-mentioned objects can be attained, according to the present invention, by an electrophotographic photosensitive member comprising a support and a photosensitive layer formed thereon, wherein the photosensitive layer contains a fluorene compound represented by the following formula (1):

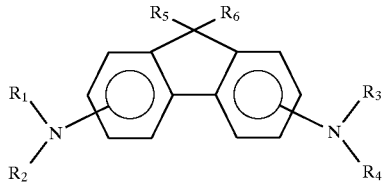

(1)

wherein $R_1$, $R_2$, $R_3$ and $R_4$ are each independently substituted or unsubstituted aryl, and $R_5$ and $R_6$ are each independently hydrogen, substituted or unsubstituted alkyl, substituted or unsubstituted aryl, substituted or unsubstituted aralkyl, and a hindered phenol compound.

The present invention also provides a process cartridge and an electrophotographic apparatus having the aforementioned electrophotographic photosensitive member.

DETAILED DESCRIPTION OF THE PREFERRED EMBODIMENTS

Figure 1:
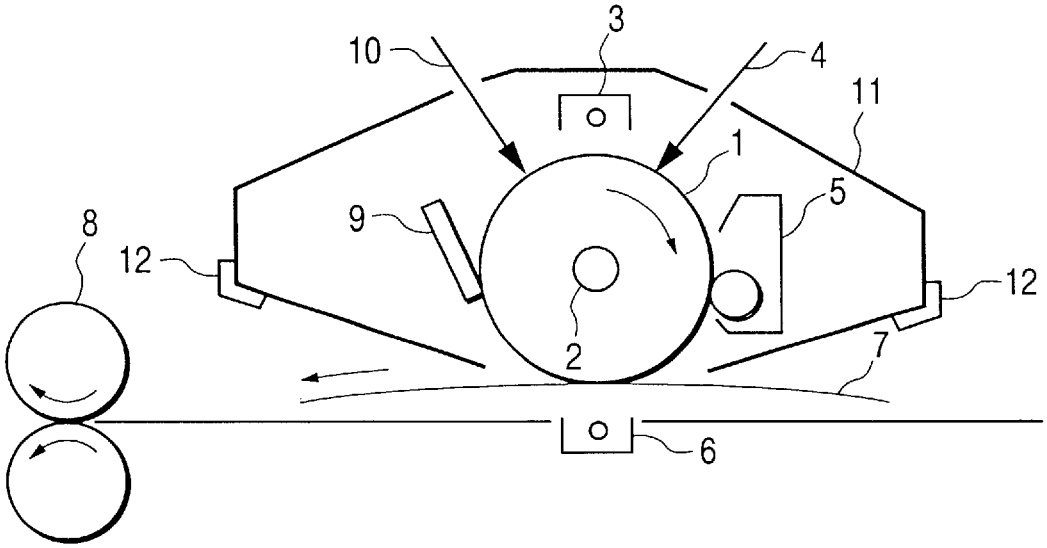
FIG. 1 is a schematic view of an electrophotographic apparatus provided with a process cartridge having the electrophotographic photosensitive member of the present invention.

The photosensitive layer of the electrophotographic photosensitive member of the present invention contains a hindered phenol compound and a fluorene compound represented by the following formula (1):

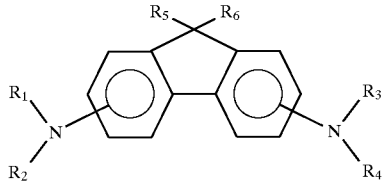

(1)

wherein $R_1$, $R_2$, $R_3$ and $R_4$, which may be the same or different, are each substituted or unsubstituted aryl groups, and $R_5$ and $R_6$, which may be the same or different, are selected from the group consisting of a hydrogen atom, a substituted or unsubstituted alkyl group, a substituted or unsubstituted aryl group and a substituted or unsubstituted aralkyl group.

In the formula (1), the aryl group includes phenyl, naphthyl and pyrenyl; the alkyl group includes methyl, ethyl, propyl and butyl; and the aralkyl group includes benzyl, phenethyl and naphthylmethyl.

These radicals may be substituted with alkyl such as methyl, ethyl or propyl, alkoxy such as methoxy or ethoxy, or aryl such as phenyl or naphthyl.

It is preferred that when one of $R_5$ and $R_6$ is hydrogen, the other is not hydrogen.

The hindered phenol compound employed in the present invention is a phenolic compound with a structure having a substituent in at least one of ortho-positions to a hydroxyl group or a alkoxyl group directly bonded to a benzene ring (hindered phenol structure). The substituent at the ortho-position may include various groups, while an alkyl group or an aralkyl group is preferable.

Such alkyl group includes straight-chain or branched propyl, butyl, pentyl, hexyl and octyl, and cyclopentyl and cyclohexyl. Examples of such aralkyl include benzyl and phenetyl.

These groups may be substituted with alkyl such as methyl or ethyl, alkoxy such as methoxy or ethoxy, or halogen such as fluorine, chlorine or bromine.

The following are desirable examples of the fluorene compound (indicated by CT numbers) represented by the formula (1), and those of the hindered phenol compound (indicated by HP numbers), but the present invention is by no means limited thereto.

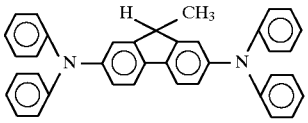
CT-1

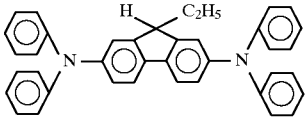
CT-2

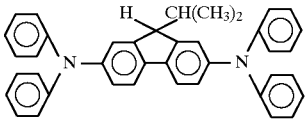
CT-3

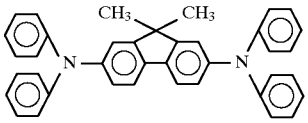
CT-4

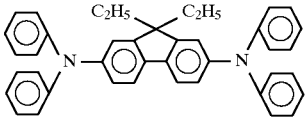
CT-5

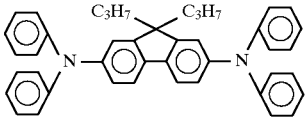
CT-6

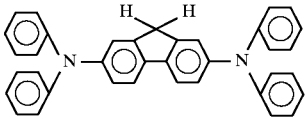
CT-7

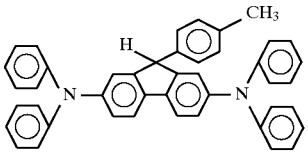
CT-8

-continued

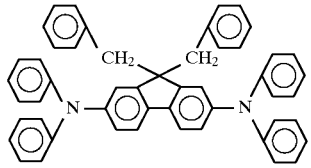
CT-9

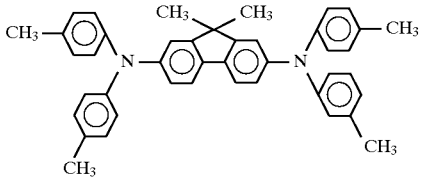
CT-10

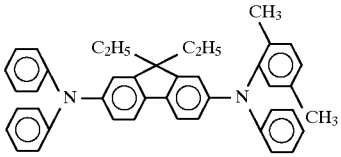
CT-11

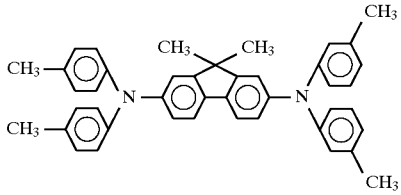
CT-12

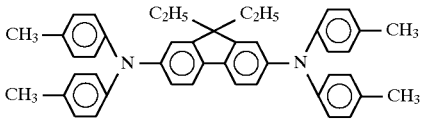
CT-13

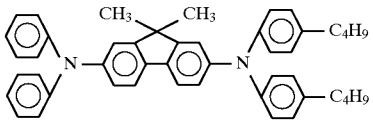
CT-14

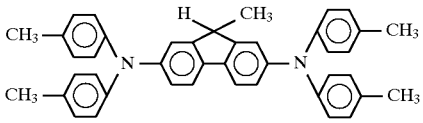
CT-15

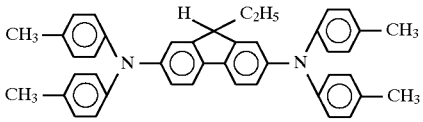
CT-16

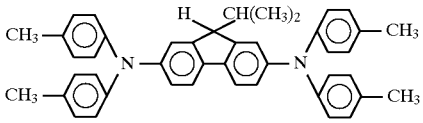
CT-17

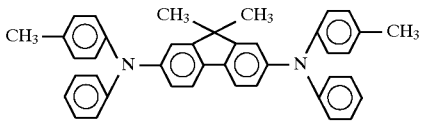
CT-18

-continued
CT-19
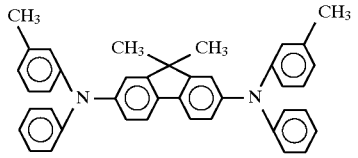
CT-20
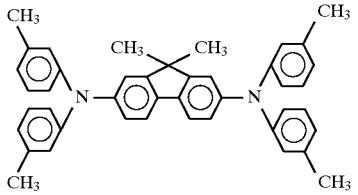
CT-21
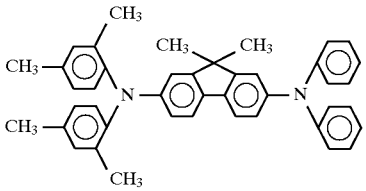
CT-22
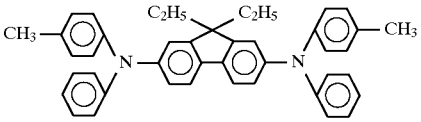
CT-23
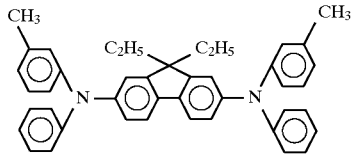
CT-24
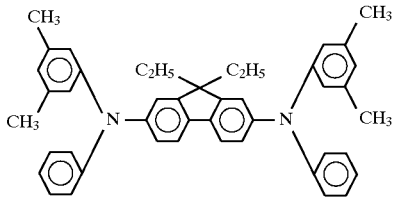
CT-25
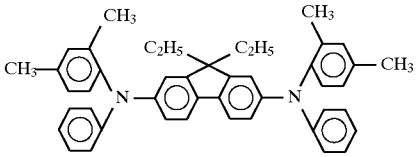
CT-26
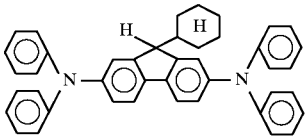
CT-27
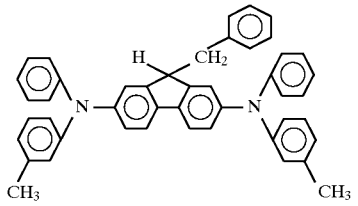
-continued
CT-28
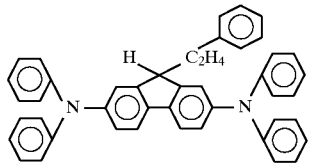
CT-29
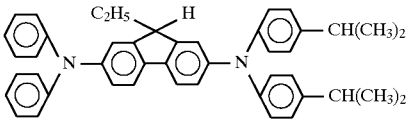
CT-30
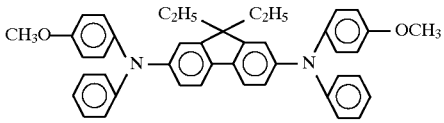
CT-31
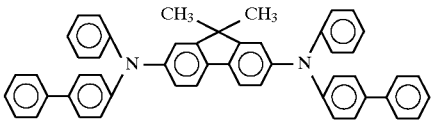
CT-32
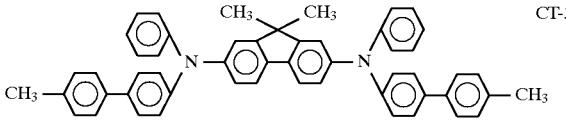
CT-33
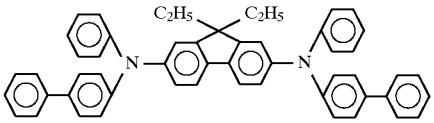
CT-34
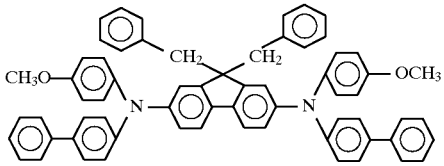
CT-35
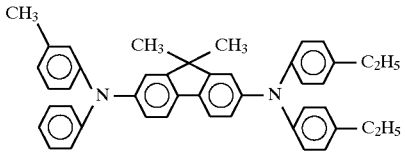
CT-36
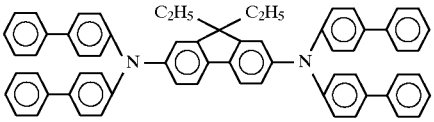
CT-37
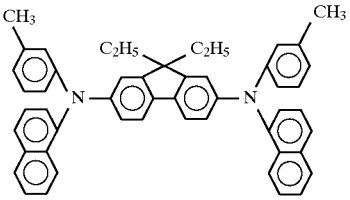

-continued
CT-38
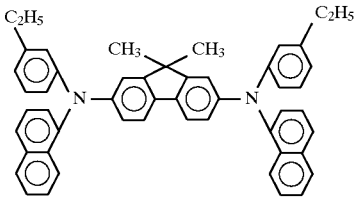
CT-39
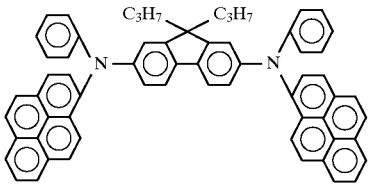
CT-40
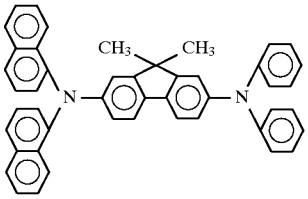
CT-41
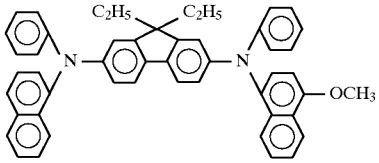
CT-42
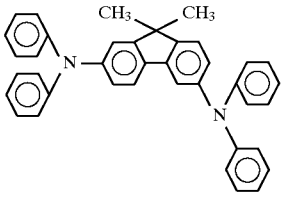
CT-43
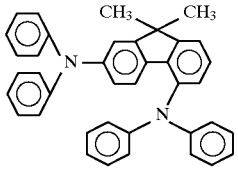
CT-44
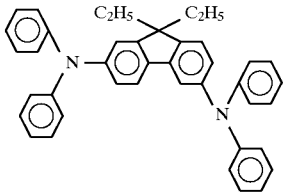
CT-45
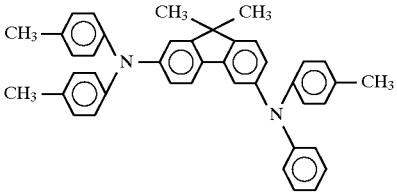
-continued
CT-46
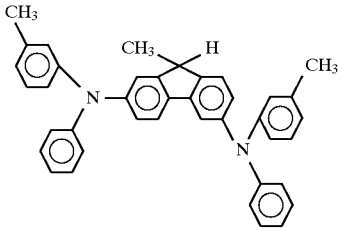
CT-47
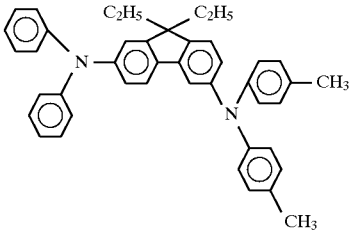
CT-48
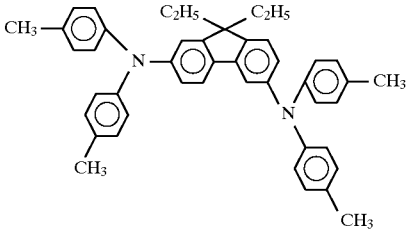
CT-49
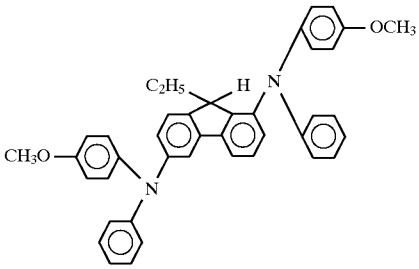
Of the foregoing examples, preferred ones are CT-4, CT-10, CT-12, CT-19 and CT-20.
HP-1
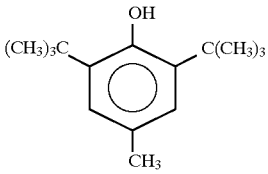
HP-2
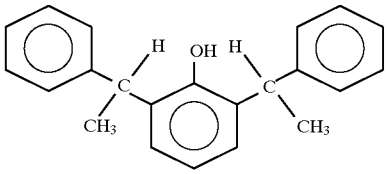
HP-3
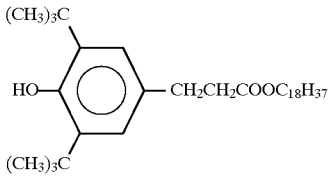

-continued
HP-4
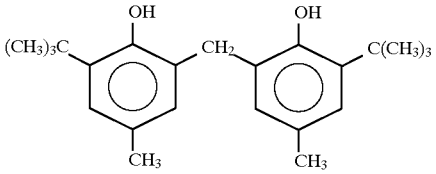
HP-5
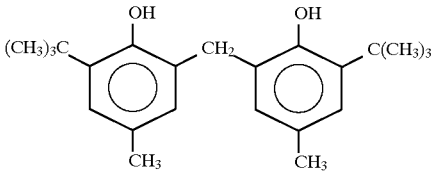
HP-6
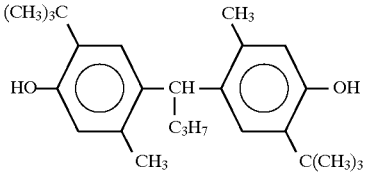
HP-7
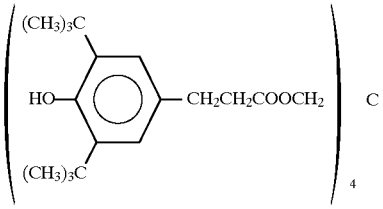
HP-8
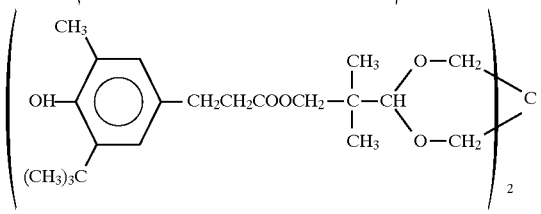
HP-9
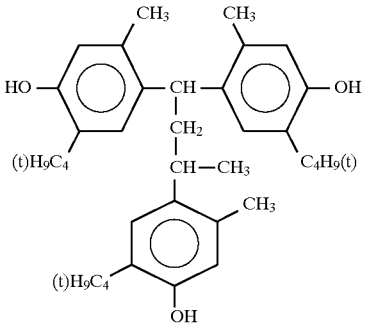
HP-10
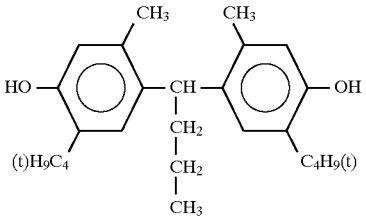
HP-11
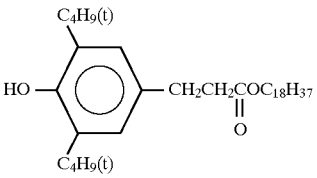
-continued
HP-12
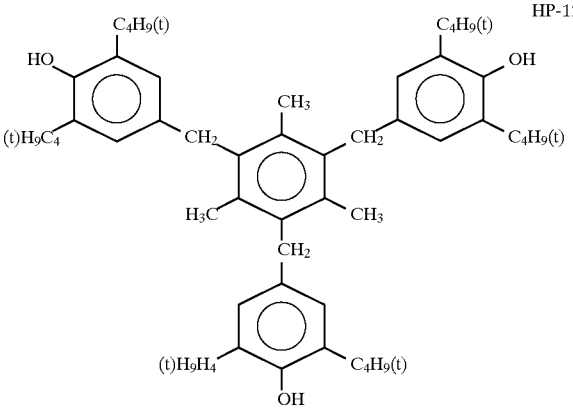
HP-13
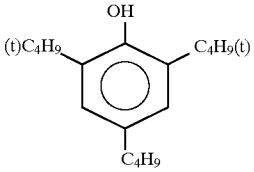
HP-14
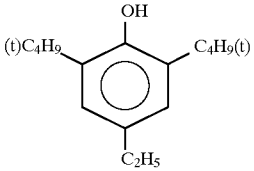
HP-15
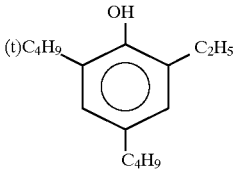
HP-16
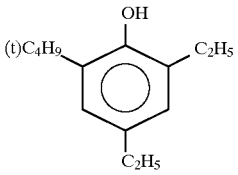
HP-17
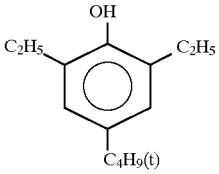
HP-18
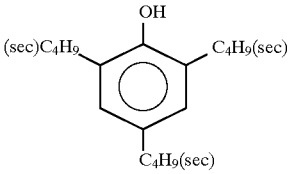

-continued
HP-19
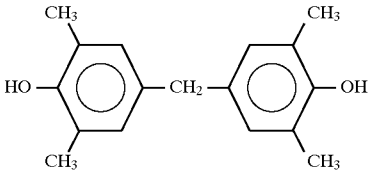
HP-20
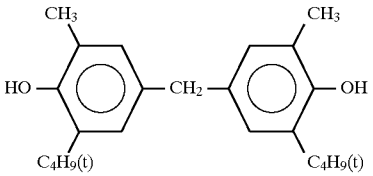
HP-21
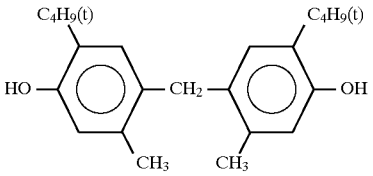
HP-22
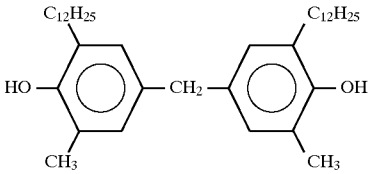
HP-23
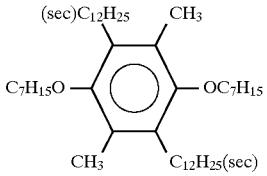
HP-24
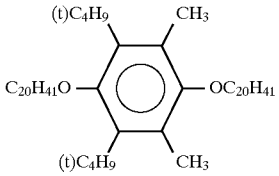
HP-25
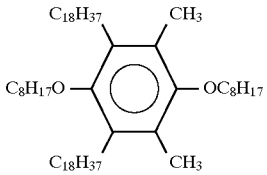
HP-26
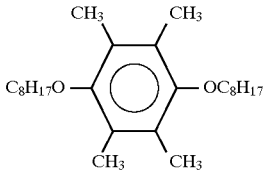
HP-27
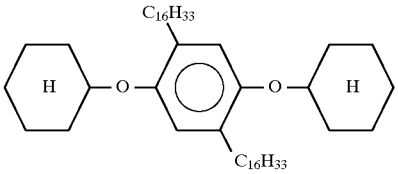
-continued
HP-28
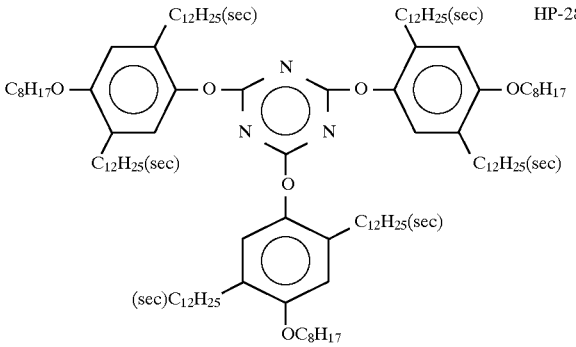
HP-29
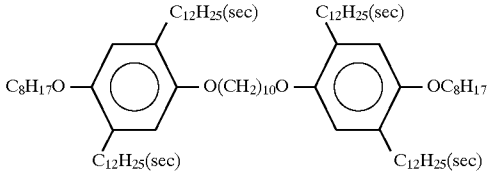
HP-30
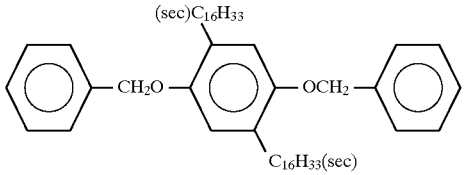
HP-31
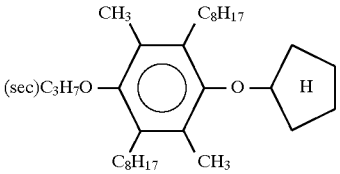
HP-32
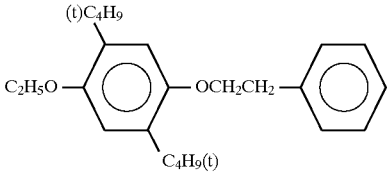
HP-33
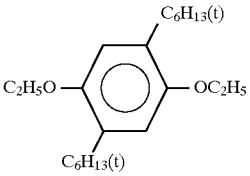
HP-34
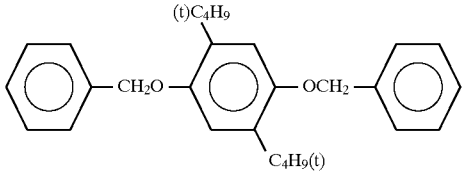
HP-35
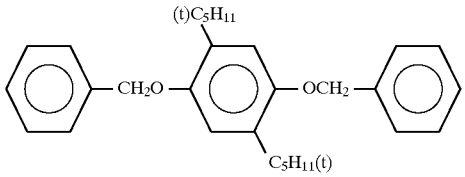

-continued

HP-36

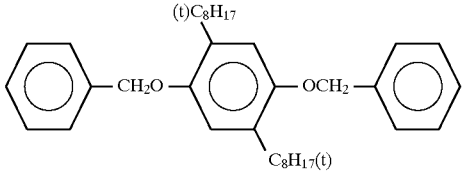

Of the foregoing examples, preferred ones are HP-1 and HP2.

The fluorene compound employed in the present invention may be synthesized by a method described in Japanese Patent Application Laid-Open No. 62-208054. The hindered phenol compound employed in the present invention may be synthesized by various methods, and some of the compounds shown above as examples are commercially available.

The electrophotographic photosensitive member of the present invention may assume any configuration, as long as the photosensitive layer contains the fluorene compound and the hindered phenol compound in the same layer. For example, it may be a single-layer type containing a charge generating material and a charge transport material in the same layer, or a laminated-layer type which is functionally separated into a charge generating layer containing a charge generating material and a charge transporting layer containing a charge transport material. In the present invention, however, the laminated-layer type is preferable and particularly, it is preferred that a charge transporting layer is formed on a charge generating layer.

The photosensitive member of the laminated-layer type will be described below.

The charge transport layer in the present invention may be formed by applying and drying a solution obtained by dissolving the fluorene compound and the hindered phenol compound, which are a charge transport material, and a binder resin in a suitable solvent. The mixing ratio of the fluorene compound to the hindered phenol compound is such that the hindered phenol compound is used preferably in an amount of 0.03 to 30 parts by weight, more preferably 0.5 to 10 parts by weight, based on 100 parts by weight of the fluorene compound.

As the binder resin, resins heretofore used for a charge transport layer may be used, which include polyarylate, polysulfone, polyamide, acrylic resin, polyacrylonitrile, methacrylic resin, vinyl chloride resin, vinyl acetate resin, phenolic resin, epoxy resin, polyester, polycarbonate or polyurethane. The mixing ratio of such binder resin to the charge transport material in the present invention is such that the charge transport material is used preferably in an amount of 10 to 500 parts by weight based on 100 parts by weight of the binder resin. The thickness of the charge transport layer is preferably within a range from 0.5 to 40 $\mu$m, more preferably 10 to 30 $\mu$m.

The charge generating layer in the present invention may be formed by applying and drying a dispersion obtained by dispersing a charge generating material in a binder resin. Examples of such charge generating material include quinone pigments, perylene pigments, indigo pigments, azulenium pigments, azo pigments and phthalocyanine pigments, among which particularly preferred are azo pigments and phthalocyanine pigments.

Examples of the phthalocyanine pigments include metal-free phthalocyanines, copper phthalocyanines, gallium phthalocyanines and oxytitanium phthalocyanines, among which preferred are oxytitanium phthalocyanines in view of conformity with the fluorene compound used in the present invention having a relatively low oxidation potential. Such oxytitanium phthalocyanines are described, for example, in Japanese Patent Application Laid-Open Nos. 61-239248, 62-67094, 3-128973 and 3-200790, among which particularly preferred is oxytitanium phthalocyanine of a crystalline form having characteristic peaks of CuK $\alpha$ characteristic X-ray diffraction at Bragg angles (2 $\theta \pm 0.2°$) of 9.0°, 14.2°, 23.9° and 27.1°.

The binder resin to be employed may be selected from various insulating resins, for example, polyvinyl butyral, polyvinyl alcohol, polyarylate, polyamide, acrylic resin, polyvinyl acetate, phenolic resin, epoxy resin, polyester, polycarbonate, polyurethane and cellulose. The resin content in the charge generating layer is preferably 80 wt. % or less, more preferably 50 wt. % or less. The thickness of the charge generating layer is preferably 5 $\mu$m or less, more preferably from 0.05 to 2 $\mu$m.

The photosensitive layer of a single-layer type will be described below.

The photosensitive layer of the single layer type may be formed by applying and drying a solution obtained by dissolving the fluorene compound and the hindered phenol compound, which are a charge transport material, and a charge generating material in the above-mentioned resin with a suitable solvent. The thickness of the photosensitive layer of the single layer type is preferably within a range of 5 to 40 $\mu$m, more preferably 10 to 30 $\mu$m.

The support used in the present invention may be composed of any electroconductive support, for example, a metal such as aluminum, chronium, nickel, stainless steel, copper or zinc, or alloy thereof, a plastic film on which a metal foil such as of aluminum or copper is laminated; a plastic film having thereon a film such as of aluminum, indium oxide or tin oxide, formed by vapor deposition or a metal, a plastic film or a paper film provided with a conductive layer formed by applying a conductive material alone or in combination with a suitable binder resin.

Examples of such conductive material include metal powder, a metal film and metal fibers such as of aluminum, copper, nickel or silver; conductive metal oxides such as antimony oxide, indium oxide or tin oxide; conductive polymer materials such as polypyrrole, polyaniline or polymer electrolytes; carbon black, graphite and organic or inorganic electrolytes; and conductive powder the surface of which is covered with such conductive material.

The support may be formed as a drum, a sheet or a belt, but it is preferably shaped in a form most suitable for the electrophotographic apparatus to be employed.

In the present invention, a subbing layer may be formed between the support and the photosensitive layer. The subbing layer functions as a barrier layer for controlling charge injection at the interface with the photosensitive layer, or as an adhesion layer. The subbing layer is principally composed of a resinous material, but it may also contain the above-mentioned metal or alloy, an oxide or a salt thereof, and a surfactant. Examples of the resin constituting the subbing layer include polyester, polyurethane, polyacrylate, polyethylene, polystyrene, polybutadiene, polycarbonate, polyamide, polypropylene, polyimide, phenolic resin, acrylic resin, silicone resin, epoxy resin, urea resin, allyl resin, alkyd resin, polyamidimide, polysulfone, polyallyl ether, polyacetal and butyral resin. The thickness of the subbing layer is preferably within a range of 0.05 to 7 $\mu$m, more preferably 0.1 to 2 $\mu$m.

The layers mentioned above may be formed by vapor deposition or coating. The coating method is preferred because it can provide films of a wide thickness range with various compositions. Examples of such coating method include dip coating, spray coating, bead coating, bar coating, blade coating and roller coating.

The electrophotographic photosensitive member of the present invention is applicable not only in an electrophotographic copying apparatus but also in other fields in which electrophotography is applied, such as a laser beam printer, a CRT printer, an LED printer, a liquid crystal printer, a facsimile apparatus and a laser plate setter.

FIG. 1 is a schematic view of an electrophotographic apparatus provided with a process cartridge having the electrophotographic photosensitive member of the present invention.

Referring to FIG. 1, a drum-shaped electrophotographic photosensitive member 1 of the present invention is rotated around a shaft 2 at a predetermined peripheral speed in the direction indicated by an arrow. In the course of rotation, the photosensitive member 1 is subjected, at its peripheral surface, to uniform charging to a predetermined positive or negative potential by primary charging means 3, and is then exposed to imagewise exposuring light 4 from image exposure means (not shown) such as slit exposure means or laser beam scanning exposure means. In this manner electrostatic latent images are formed in succession on the periphery of the photosensitive member 1.

The electrostatic latent images thus formed are then developed with toner by developing means 5, and the developed toner images are transferred in succession by transfer means 6 onto a transfer-receiving material 7 fed from a sheet feeder (not shown) into a gap between the photosensitive member 1 and the transfer means 6 in synchronization with the rotation of the photosensitive member 1.

The transfer material 7 subjected to image transfer is separated from the photosensitive member, introduced into image fixing means 8 and subjected to image fixation, and the formed copy is discharged from the apparatus.

The surface of the photosensitive member 1 after the image transfer is cleaned by the removal of the remaining toner with cleaning means 9, then subjected to charge-elimination by pre-exposure light 10 from pre-exposure means (not shown), and used again for image formation. However, such pre-exposure may be dispensed with in case the primary charging means 3 is contact charging means utilizing a charging roller or the like.

In the present invention, two or more components of the electrophotographic photosensitive member 1, the primary charging means 3, the developing means 5, the cleaning means 9, etc. may be combined together to compose a process cartridge which is detachable from the body of an electrophotographic apparatus such as a copying machine or a laser beam printer. As an example, at least one of the primary charging means 3, the developing means 5 and the cleaning means 9 may be integrally supported with the photosensitive member 1 in the form of a process cartridge 11 which is mounted in and detached from the apparatus by suitable guide means such as a rail 12.

The imagewise exposing light 4 may be, in case the electrophotographic apparatus is a copying apparatus or a printer, the light reflected from or transmitted through an original, the scanning of a laser beam according to the signals obtained by reading an original with a sensor or the light irradiated by driving an LED array or a liquid crystal shutter array.

The present invention will be described below in more detail with specific embodiments, wherein parts are by weight.

[EXAMPLE 1]

A conductive layer-forming paint was obtained by dispersing 50 parts of conductive titanium oxide powder coated with tin oxide containing antimony oxide in an amount of 10%, 25 parts of phenolic resin, 30 parts of methyl cellosolve, 30 parts of methanol and 0.002 parts of silicone oil (polydimethylsiloxane-polyoxyalkylene copolymer with a weight-averaged molecular weight of 3,000) for 2 hours in a sand mill employing glass beads of 1 mm ϕ. The paint was applied by dip coating on an aluminum cylinder and dried for 30 minutes at 140° C. to form a conductive layer of a thickness of 20 μm.

A solution was prepared by dissolving 10 parts of alcohol-soluble copolymer nylon resin (weight-averaged molecular weight of 29,000) and 30 parts of methoxymethylated 6-nylon resin (weight-averaged molecular weight of 32,000) in a mixed solvent of 260 parts of methanol and 40 parts of butanol. The solution was applied by dip coating on the abovementioned conductive layer and drived for 10 minutes at 90° C. to form a subbing layer of a thickness of 1 μm.

A dispersion for forming a charge generating layer was prepared by dispersing 4 parts of a diazo pigment represented by the following formula as a charge generating material, along with solution obtained by dissolving 2 parts of polyvinylbenzal (degree of benzalation 80%, weight-averaged molecular weight 10,000) in 30 parts of cyclohexanone, for 20 hours in a sand mill employing glass beads of 1 mm ϕ, followed by addition of 60 parts of methyl ethyl ketone. The obtained dispersion was applied by dip coating on the above-mentioned subbing layer and dried for 10 minutes at 80° C. to form a charge generating layer of a thickness of 0.30 μm.

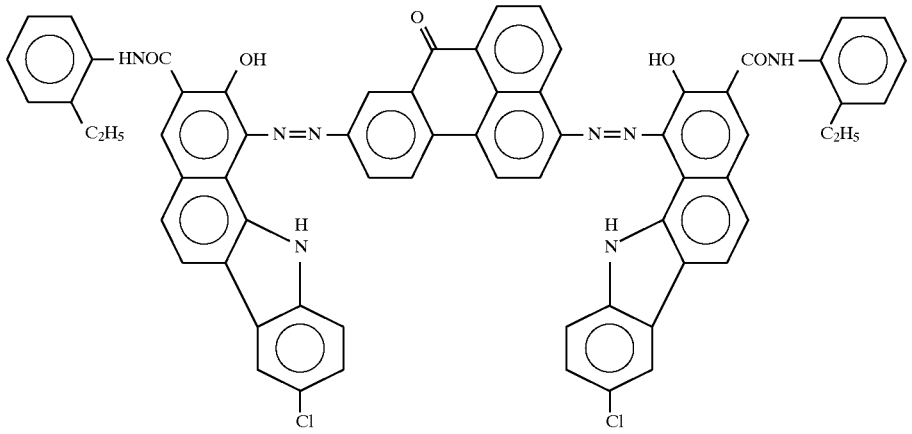

A solution was obtained by dissolving 10 parts of the aforementioned fluorene compound CT-4 as a charge transport material, 0.7 parts of the aforementioned hindered phenol compound HP-1 and 10 parts of polycarbonate (weight-averaged molecular weight of 46,000) in a mixed solvent of 20 parts of dichloromethane and 50 parts of monochlorobenzene. The solution was applied by dip coating on the abovementioned charge generating layer and dried for 60 minutes at 120° C. to form a charge transport layer of a thickness of 20 μm.

The electrophotographic photosensitive member thus prepared was mounted on the modified body of a laser beam printer (LBP-SX manufactured by CANON INC.), charged to a dark potential of −700 V and irradiated with a laser light of a wavelength of 802 nm, and the sensitivity was determined by measuring the quantity of light required for obtaining a light potential of −200 V.

After 60,000 successive image formation cycles were carried out as a durability test, a dark potential variation Δ Vd and a light potential variation Δ Vl from their initial values were measured, and the formed images were evaluated according to inspection by naked eye. A positive value of Δ Vd or Δ Vl indicates an increase in the absolute value of the potential, and a negative value indicates a decrease in the absolute value of the potential.

The transfer memory was determined according to $|V_{d1}-V_{d2}|$, wherein $V_{d1}$ and $V_{d2}$ indicate respectively the dark potentials when the transfer current is turned off and on.

The obtained results are summarized in Table 1.

[EXAMPLES 2–9]

Electrophotographic photosensitive members were prepared and evaluated in the same manner as in Example 1, except that the fluorene compound, the hindered phenol compound and the amount thereof were modified as shown in Table 1.

The obtained results are summarized in Table 1.

[Reference Examples 1–9]

Electrophotographic photosensitive members were prepared and evaluated in the same manner as in Examples 1–9, except that the hindered phenol compound was not employed.

The obtained results are summarized in Table 1.

TABLE 1

| | Compound | | Amount of hindered | Sensitivity | Durability test | | | Transfer memory |
|---|---|---|---|---|---|---|---|---|
| | CT | HP | phenol (pt) | (μJ/cm²) | ΔVd (V) | ΔVl (V) | Image quality | (V) |
| Ex. 1 | 4 | 1 | 0.7 | 0.71 | 0 | −5 | satisfactory | 10 |
| Ex. 2 | 2 | 4 | 0.5 | 0.73 | −5 | −5 | satisfactory | 5 |
| Ex. 3 | 10 | 14 | 1 | 0.70 | 0 | −5 | satisfactory | 10 |
| Ex. 4 | 19 | 19 | 0.3 | 0.66 | 0 | −5 | satisfactory | 0 |
| Ex. 5 | 25 | 1/15 | 0.2/0.2 | 0.68 | 0 | −10 | satisfactory | 10 |
| Ex. 6 | 34 | 21 | 0.8 | 0.70 | −5 | −10 | satisfactory | 5 |
| Ex. 7 | 37 | 33 | 0.1 | 0.71 | −5 | −5 | satisfactory | 10 |
| Ex. 8 | 42 | 12 | 0.5 | 0.69 | −5 | −5 | satisfactory | 10 |
| Ex. 9 | 45 | 35 | 0.7 | 0.73 | 0 | −5 | satisfactory | 5 |
| Ref. Ex. 1 | 4 | — | — | 0.71 | −25 | −30 | fog | 25 |
| Ref. Ex. 2 | 2 | — | — | 0.73 | −30 | −25 | fog | 20 |
| Ref. Ex. 3 | 10 | — | — | 0.68 | −25 | −30 | fog | 30 |
| Ref. Ex. 4 | 19 | — | — | 0.66 | −25 | −25 | fog | 20 |
| Ref. Ex. 5 | 25 | — | — | 0.67 | −35 | −30 | fog/blur | 25 |
| Ref. Ex. 6 | 34 | — | — | 0.71 | −35 | −30 | fog/blur | 20 |
| Ref. Ex. 7 | 37 | — | — | 0.71 | −25 | −35 | fog | 30 |
| Ref. Ex. 8 | 42 | — | — | 0.68 | −30 | −25 | fog | 25 |
| Ref. Ex. 9 | 45 | — | — | 0.72 | −25 | −30 | fog/blur | 20 |

[EXAMPLE 10]

A conductive layer-forming paint was obtained by dispersing 10 parts of conductive titanium oxide powder coated with tin oxide, 10 parts of non-conductive titanium oxide powder, 10 parts of phenolic resin, 10 parts of methyl cellosolve, 10 parts of methanol and 0.001 parts of silicone oil (polydimethylsiloxane-polyoxyalkylene copolymer with a weight-averaged molecular weight of 3,000) for 4 hours in a sand mill employing glass beads of 1 mm ϕ. The paint was applied by dip coating on an aluminum cylinder and dried for 30 minutes at 140° C. to form a conductive layer of a thickness of 15 μm.

A solution was p re pared by dissolving 10 parts of alcohol-soluble copolymerized nylon resin (weight-averaged molecular weight of 29,000) and 30 parts of methoxymethylated 6-nylon resin (weight-averaged molecular weight of 32,000) in mixed solvent consisting of 260 parts of methanol and 40 parts of butanol. The solution was applied by dip coating on the abovementioned conductive layer and dried for 10 minutes at 90° C. to form a subbing layer of a thickness of 0.5 μm.

Figure 2:
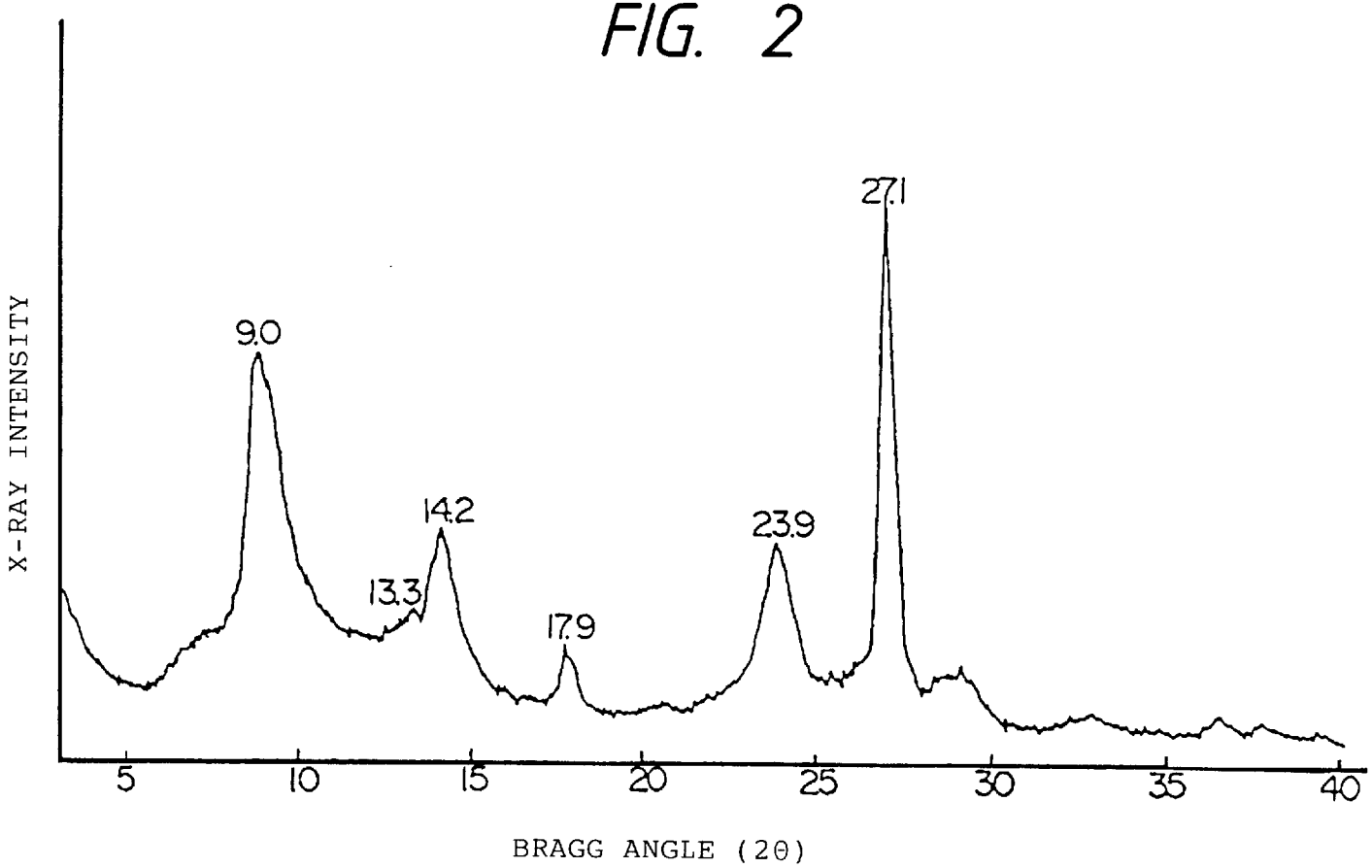
FIG. 2 is an X-ray diffraction chart of I-type oxytitanium phthalocyanine.
Figure 3:
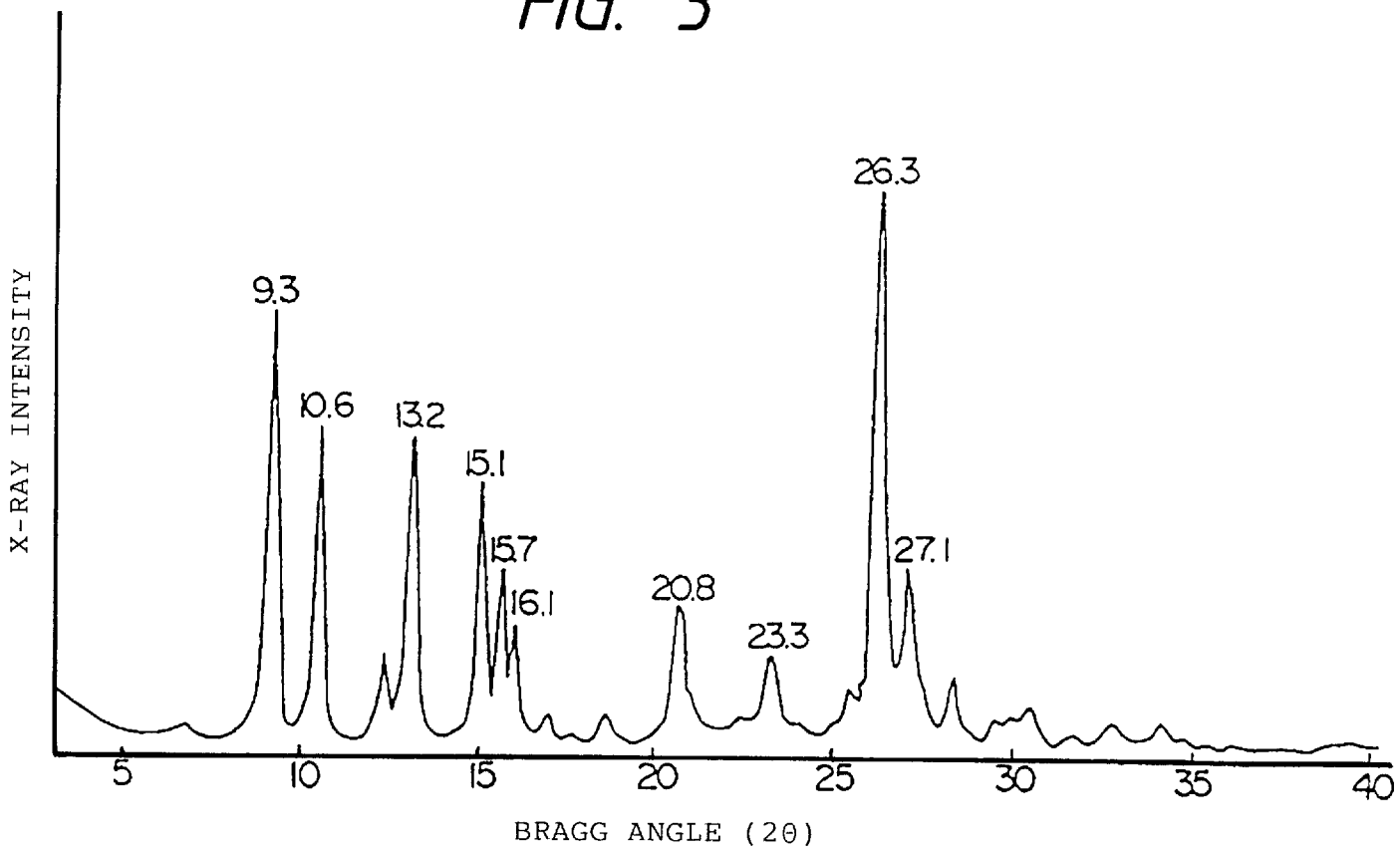
FIG. 3 is an X-ray diffraction chart of A-type oxytitanium phthalocyanine.
Figure 4:
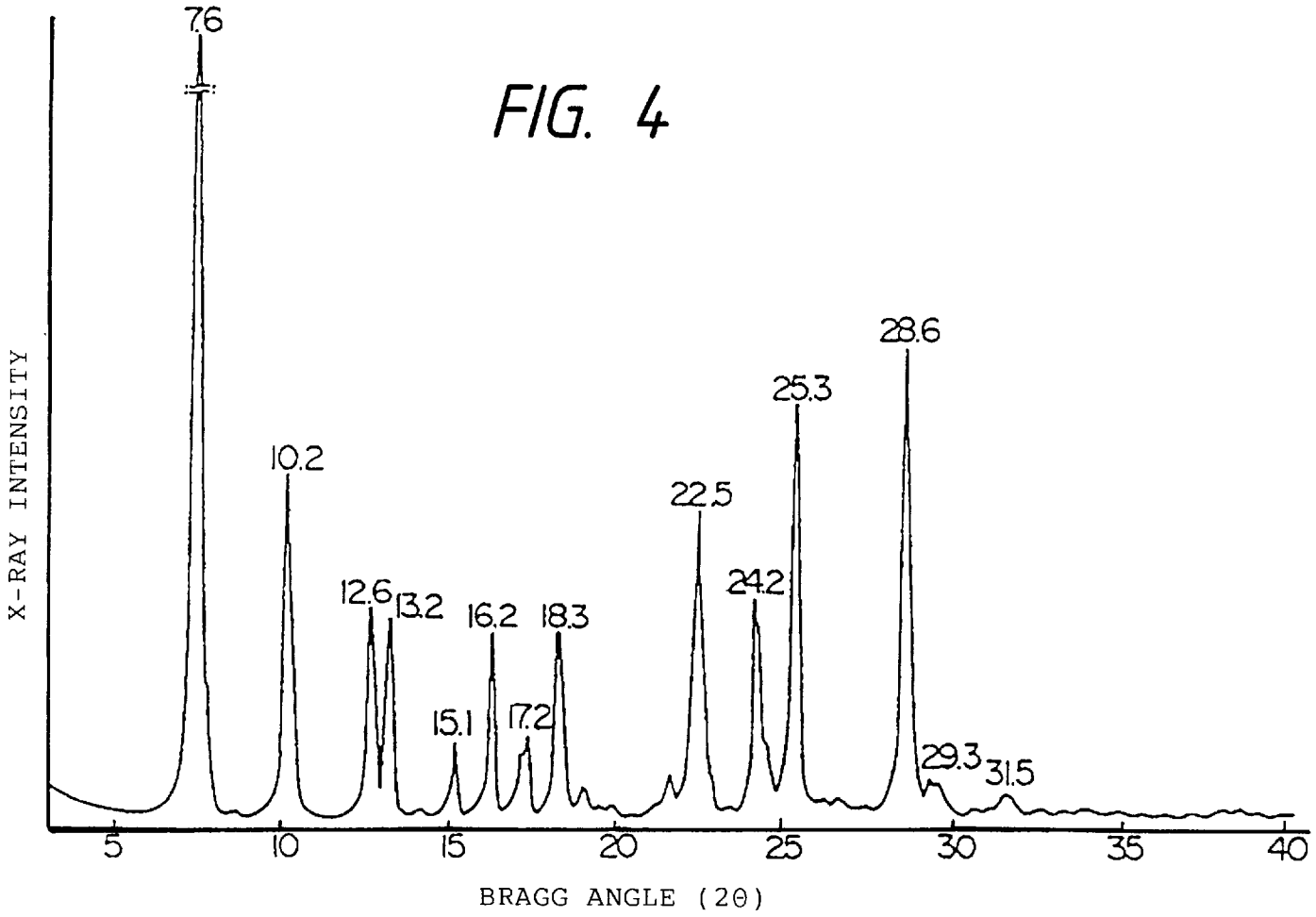
FIG. 4 is an X-ray diffraction chart of B-type oxytitanium phthalocyanine.
Figure 5:
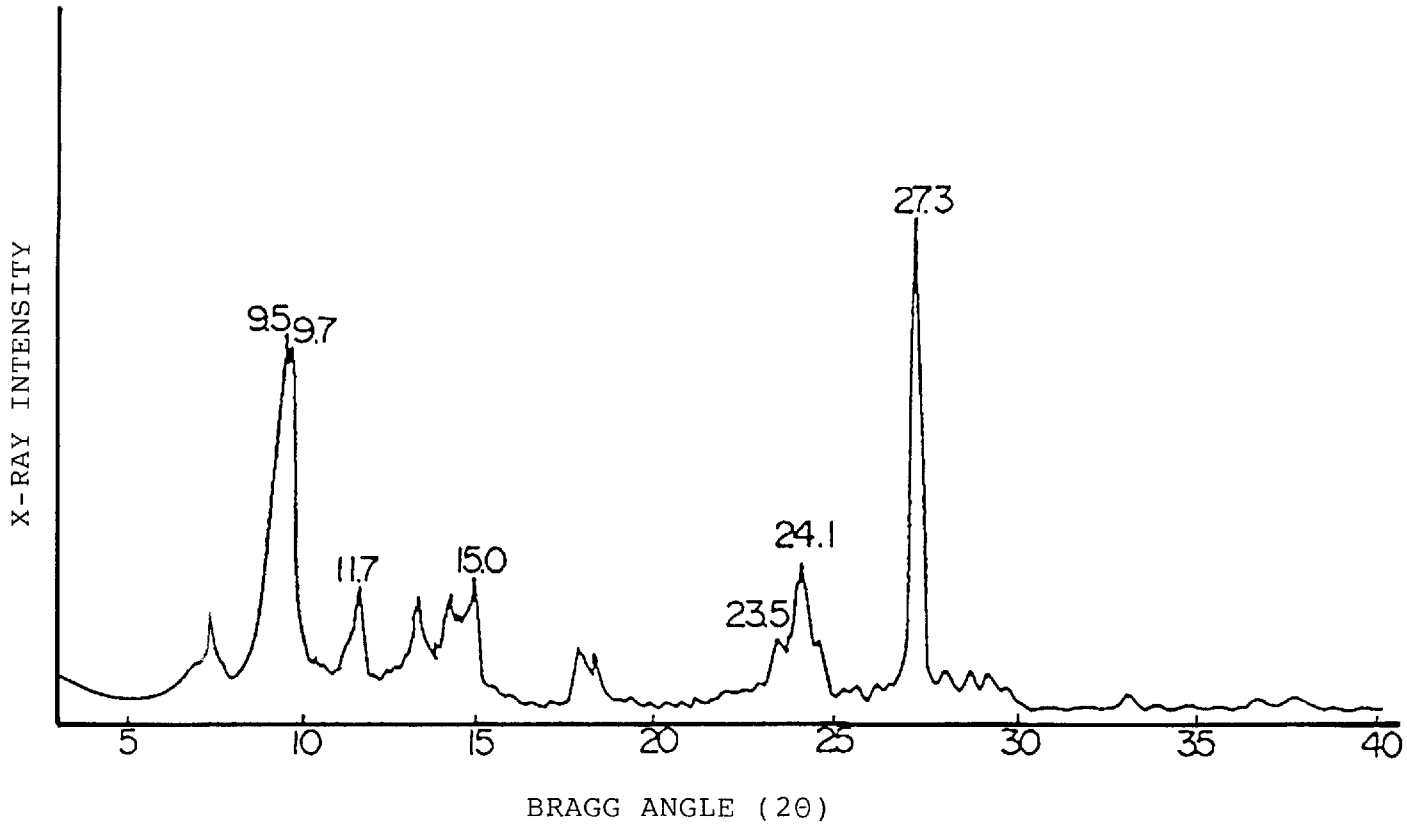
FIG. 5 is an X-ray diffraction chart of Y-type oxytitanium phthalocyanine.

A dispersion for forming the charge generating layer was prepared by dispersing 10 parts of oxytitanium phthalocyanine of a crystalline form showing characteristic peaks in CuK α characteristic X-ray diffraction at Bragg angles (2 θ±0.2°) of 9.0°, 14.2°, 23.9° and 27.1° (as shown in FIG. 2, the compound hereinafter referred to as I-type oxytitanium phthalocyanine) as the charge generating material, along with a solution obtained by dissolving 10 parts of polyvinylbutyral (Eslec BX-1 manufactured by Sekisui Chemical Co., Ltd.) in 400 parts of cyclohexanone, for 4 hours in a sand mill employing glass beads of 1 mm followed by addition of 400 parts of ethyl acetate. The obtained dispersion was applied by dip coating on the above-mentioned subbing layer and dried for 10 minutes at 80° C. to form a charge generating layer of a thickness of 0.25 μm.

A solution was obtained by dissolving 10 parts of the aforementioned fluorene compound CT-19 and 0.3 parts of the aforementioned hindered phenol compound HP-12 as the charge transport material, and 10 parts of polycarbonate (weight-averaged molecular weight of 46,000) in a mixed solvent of 20 parts of dichloromethane and 50 parts of monochlorobenzene. The solution was applied dip coating on the above-mentioned charge generating layer and dried for 60 minutes at 110° C. to form a charge transport layer of a thickness of 22 $\mu$m.

The electrophotographic photosensitive member thus prepared was mounted on the modified body of a laser beam printer (LBP-EX manufactured by CANON INC.) charged to a dark potential of −700 V and irradiated with a laser light of a wavelength of 780 nm, and the sensitivity was determined by measuring the quantity of light required for obtaining a light potential of −150 V. The durability and the transfer memory were evaluated in the same manner as in the Example 1, except for the use of the above-mentioned laser beam printer.

The obtained results are summarized in Table 2.

[EXAMPLES 11–20]

Electrophotographic photosensitive members were prepared and evaluated in the same manner as in Example 10, except that the fluorene compound, the hindered phenol compound and the amount thereof were modified as shown in Table 2.

The obtained results are summarized in Table 2.

[Reference Examples 10–20]

Electrophotographic photosensitive members were prepared and evaluated in the same manner as in Examples 10–20, except that the hindered phenol compound was not employed.

The obtained results are summarized in Table 2.

[Reference Examples 21–24]

Electrophotographic photosensitive members were prepared and evaluated in the same manner as in the Example 10, except that the fluorene compounds were replaced by the following reference compounds CTM-1 to CTM-4.

The obtained results are summarized in Table 3.

Reference CTM-1

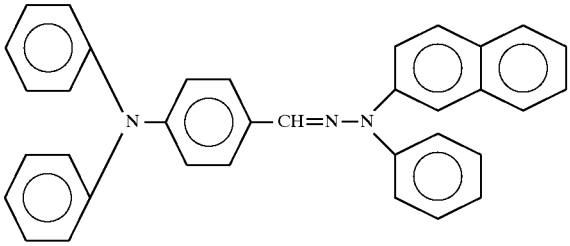

(Japanese Patent Application Laid-Open No. 64-44451)

Reference CTM-2

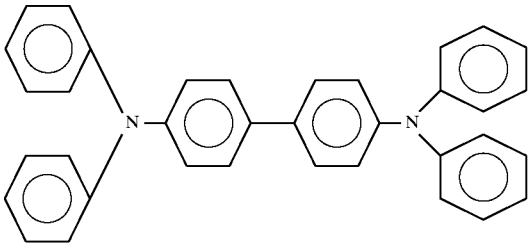

(Japanese Patent Application Laid-Open No. 64-44451)

TABLE 2

| | Compound | | Amount of hindered | Sensitivity | Durability test | | | Transfer memory |
|---|---|---|---|---|---|---|---|---|
| | CT | HP | phenol (pt) | ($\mu$J/cm$^2$) | ΔVd (V) | ΔVl (V) | Image quality | (V) |
| Ex. 10 | 19 | 12 | 0.3 | 0.19 | 0 | −5 | satisfactory | 15 |
| Ex. 11 | 1 | 6 | 0.5 | 0.22 | 0 | 0 | satisfactory | 15 |
| Ex. 12 | 6 | 3 | 0.05 | 0.21 | −5 | −5 | satisfactory | 15 |
| Ex. 13 | 9 | 16 | 0.1 | 0.21 | 0 | −5 | satisfactory | 15 |
| Ex. 14 | 12 | 1 | 0.3 | 0.17 | 0 | 0 | satisfactory | 10 |
| Ex. 15 | 20 | 13 | 0.5 | 0.19 | 0 | 0 | satisfactory | 10 |
| Ex. 16 | 26 | 21 | 1 | 0.21 | 0 | 5 | satisfactory | 10 |
| Ex. 17 | 31 | 25 | 0.3 | 0.22 | −5 | −5 | satisfactory | 10 |
| Ex. 18 | 40 | 32 | 0.1 | 0.20 | 0 | −10 | satisfactory | 15 |
| Ex. 19 | 44 | 36 | 0.5 | 0.22 | −5 | 0 | satisfactory | 15 |
| Ex. 20 | 46 | 6/18 | 0.1/0.1 | 0.19 | −5 | −5 | satisfactory | 15 |
| Ref. Ex. 10 | 19 | — | — | 0.18 | −20 | −30 | fog | 35 |
| Ref. Ex. 11 | 1 | — | — | 0.21 | −15 | −25 | fog | 35 |
| Ref. Ex. 12 | 6 | — | — | 0.21 | −20 | −30 | fog | 40 |
| Ref. Ex. 13 | 9 | — | — | 0.22 | −25 | −20 | fog/blur | 40 |
| Ref. Ex. 14 | 12 | — | — | 0.17 | −15 | −25 | fog | 30 |
| Ref. Ex. 15 | 20 | — | — | 0.18 | −15 | −30 | fog/blur | 35 |
| Ref. Ex. 16 | 26 | — | — | 0.20 | −25 | −35 | fog | 40 |
| Ref. Ex. 17 | 31 | — | — | 0.21 | −20 | −30 | fog | 35 |
| Ref. Ex. 18 | 40 | — | — | 0.20 | −20 | −25 | fog | 35 |
| Ref. Ex. 19 | 44 | — | — | 0.21 | −25 | −30 | fog/blur | 40 |
| Ref. Ex. 20 | 46 | — | — | 0.19 | −25 | −35 | fog | 30 |

-continued

Reference CTM-3

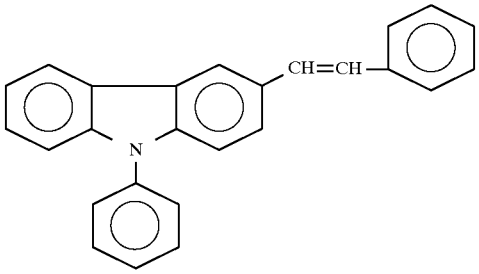

(Japanese Patent Application Laid-Open No. 64-44944)

Reference CTM-4

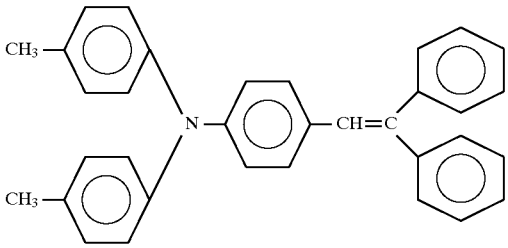

(Japanese Patent Application Laid-Open No. 2-71274)

TABLE 3

| | Compound | | Amount of hindered | Sensitivity | Durability test ΔVd | ΔVl | | Transfer memory |
|---|---|---|---|---|---|---|---|---|
| | CT | HP | phenol (pt) | ($\mu$J/cm$^2$) | (V) | (V) | Image quality | (V) |
| Ref. Ex. 21 | Ref. 1 | 12 | 0.3 | 0.28 | −35 | +65 | fog/low density | 70 |
| Ref. Ex. 22 | Ref. 2 | 12 | 0.3 | 0.38 | −25 | +90 | low density | 85 |
| Ref. Ex. 23 | Ref. 3 | 12 | 0.3 | 0.45 | −5 | +100 | low density | 70 |
| Ref. Ex. 24 | Ref. 4 | 12 | 0.3 | 0.40 | −40 | +65 | fog/low density | 60 |

[EXAMPLES 21–26]

Electrophotographic photosensitive members were prepared and evaluated in the same manner as in Examples 10 and 14, except that the oxytitanium phthalocyanines of crystalline forms shown in Table 4 were empolyed as a charge generating material.

The obtained results are summarized in Table 5.

TABLE 4

| | Cryst. Form | Main peaks in CuK α-characteristic X-ray diffraction | Xray dif. Chart |
|---|---|---|---|
| Ex. 21 | A | 9.3°, 10.6°, 13.2°, 15.1°, 15.7°, 20.8°, 23.3°, 26.3°, 27.1° | 3 |
| Ex. 22 | B | 7.6°, 10.2°, 12.6°, 13.2°, 16.2°, 18.3°, 22.5°, 24.2°, 25.3°, 28.6° | 4 |
| Ex. 23 | Y | 9.5°, 9.7°, 11.7°, 15.0°, 23.5°, 24.1°, 27.3° | 5 |
| Ex. 24 | A | 9.5°, 9.7°, 11.7°, 15.0°, 23.5°, 24.1°, 27.3° | " |
| Ex. 25 | B | 9.5°, 9.7°, 11.7°, 15.0°, 23.5°, 24.1°, 27.3° | " |
| Ex. 26 | Y | 9.5°, 9.7°, 11.7°, 15.0°, 23.5°, 24.1°, 27.3° | " |

[Reference Examples 25–30]

Electrophotographic photosensitive members were prepared and evaluated in the same manner as in Examples 21–26, except that the hindered phenol compound was not employed.

The obtained results are summarized in Table 5.

TABLE 5

| | Compound | | Amount of hindered | Sensitivity | Durability test ΔVd | ΔVl | | Transfer memory |
|---|---|---|---|---|---|---|---|---|
| | CT | HP | phenol (pt) | ($\mu$J/cm$^2$) | (V) | (V) | Image quality | (V) |
| Ex. 21 | 19 | 12 | 0.3 | 0.78 | −10 | −10 | satisfactory | 15 |
| Ex. 22 | 19 | 12 | 0.3 | 0.58 | −10 | −10 | satisfactory | 15 |
| Ex. 23 | 19 | 12 | 0.3 | 0.31 | −5 | −10 | satisfactory | 10 |
| Ex. 24 | 12 | 1 | 0.3 | 0.80 | −5 | −5 | satisfactory | 15 |
| Ex. 25 | 12 | 1 | 0.3 | 0.61 | −5 | −10 | satisfactory | 15 |
| Ex. 26 | 12 | 1 | 0.3 | 0.33 | −5 | −10 | satisfactory | 15 |
| Ref. Ex. 25 | 19 | — | — | 0.76 | −25 | −35 | fog | 45 |
| Ref. Ex. 26 | 19 | — | — | 0.57 | −30 | −40 | fog | 40 |
| Ref. Ex. 27 | 19 | — | — | 0.30 | −20 | −30 | fog | 40 |
| Ref. Ex. 28 | 12 | — | — | 0.78 | −20 | −30 | fog | 40 |
| Ref. Ex. 29 | 12 | — | — | 0.60 | −25 | −40 | fog/blur | 35 |
| Ref. Ex. 30 | 12 | — | — | 0.32 | −25 | −35 | fog | 35 |

[EXAMPLE 27]

A conductive layer and a subbing layer were formed on an aluminum cylinder in the same manner as in Example 10.

A dispersion for forming a charge generating layer was prepared by dispersing 8 parts of I-type oxytitanium phthalocyanine and 2 parts of a diazo pigment represented by the following formula as a charge generating material, along with a solution obtained by dissolving 10 parts of polyvinylbutyral (Eslec BX-1 manufactured by Sekisui Chemical Co., Ltd.) in 400 parts of cyclohexanone, for 4 hours in a sand mill employing glass beads of 1 mm ϕ, followed by addition of 400 parts of ethyl acetate. The obtained dispersion was applied by dip coating on the abovementioned subbing layer and dried for 10 minutes at 80° C. to form a charge generating layer of a thickness of 0.25 μm.

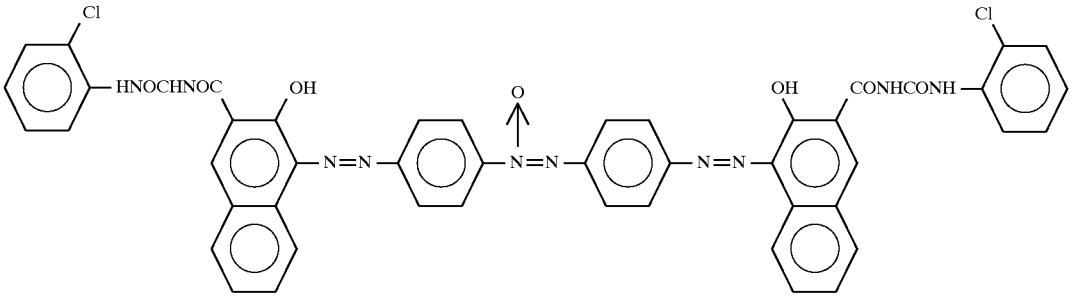

A solution obtained by dissolving 10 parts of the aforementioned fluorene compound CT-19 and 0.5 parts of the aforementioned hindered phenol compound HP-12 as a charge transport material and 10 parts of polycarbonate (weight-averaged molecular weight of 46,000) in a mixed solvent of 20 parts of dichloromethane and 50 parts of monochlorobenzene. The solution was applied by dip coating on the above-mentioned charge generating layer and died for 60 minutes at 110° C. to form a charge transport layer of a thickness of 22 μm.

The electrophotographic photosensitive member thus prepared was evaluated in the same manner as in the Example 10.

The obtained results are summarized in Table 6.

[Reference Example 31]

An electrophotographic photosensitive member was prepared in the same manner as in the Example 27, except that the hindered phenol compound was not employed.

The obtained results are summarized in Table 6.

TABLE 6

| | Compound | | Amount of hindered | Sensitivity | Durability test | | | Transfer memory |
|---|---|---|---|---|---|---|---|---|
| | CT | HP | phenol (pt) | (μJ/cm²) | ΔVd (V) | ΔVl (V) | Image quality | (V) |
| Ex. 27 | 19 | 12 | 0.5 | 0.20 | 0 | −5 | satisfactory | 5 |
| Ref. Ex. 31 | 19 | — | — | 0.19 | −15 | −20 | fog | 30 |

What is claimed is:

1. An electrophotographic photosensitive member comprising a support and a photosensitive layer provided thereon, wherein said photosensitive layer contains a hindered phenol compound and a fluorene compound represented by the following formula (1):

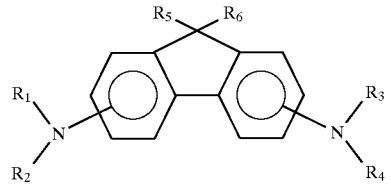

(1)

wherein $R_1$, $R_2$, $R_3$ and $R_4$ are each independently substituted or unsubstituted aryl, and $R_5$ and $R_6$ are each independently hydrogen, substituted or unsubstituted alkyl, substituted or unsubstituted aryl, or substituted or unsubstituted aralkyl.

2. An electrophotographic photosensitive member according to claim 1, wherein said hindered phenol compound is so constructed as to have a substituent in at least one of ortho-positions to hydroxy or alkoxy bonded directly to the benzene ring.

3. An electrophotographic photosensitive member according to claim 2, wherein the substituent in said hindered phenol compound is either of alkyl and aralkyl.

4. An electrophotographic photosensitive member according to claim 1, wherein said photosensitive layer has a charge generating layer and a charge transporting layer, wherein said charge transporting layer contains the fluorene compound represented by the formula (1) and the hindered phenol compound.

5. An electrophotographic photosensitive member according to claim 4, wherein said support member, said charge generating layer and said charge transporting layer are provided in this order.

6. An electrophotographic photosensitive member according to claim 1, wherein said photosensitive layer contains oxytitanium phthalocyanine as a charge generating material.

7. An electrophotographic photosensitive member according to claim 6, wherein said oxytitanium phthalocyanine has characteristic peaks in the CuK α characteristic X-ray diffraction at Bragg angles (2 θ±0.2°) of 9.0°, 14.2°, 23.90°and 27.1°.

8. A process cartridge comprising an electrophotographic photosensitive member and at least one means selected from the group consisting of a charging means, developing means and cleaning means, wherein said electrophotographic photosensitive member and said at least one means are combined together to form a single entity and detachable from the body of an electrophotographic apparatus, and said electrophotographic photosensitive member comprising a support and a photosensitive layer provided thereon, wherein said photosensitive layer contains a hindered phenol compound and a fluorene compound represented by the following formula (1):

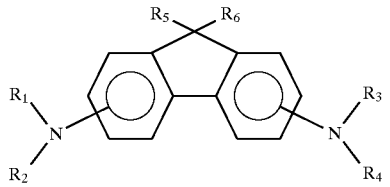

(1)

wherein $R_1$, $R_2$, $R_3$ and $R_4$ are each independently substituted or unsubstituted aryl, and $R_5$ and $R_6$ are each independently hydrogen, substituted or unsubstituted alkyl, substituted or unsubstituted aryl, or substituted or unsubstituted aralkyl.

9. An electrophotographic apparatus comprising an electrophotographic photosensitive member, charging means, exposure means, developing means and transfer means, wherein said electrophotographic photosensitive member has a support member and a photosensitive layer provided thereon, wherein said photosensitive layer contains a hindered phenol compound and a fluorene compound represented by the following formula (1):

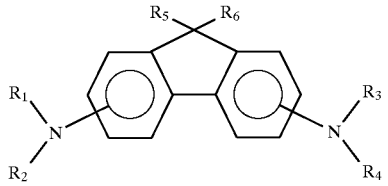

(1)

wherein $R_1$, $R_2$, $R_3$ and $R_4$ are each independently substituted or unsubstituted aryl, and $R_5$ and $R_6$ are each independently hydrogen, substituted or unsubstituted alkyl, substituted or unsubstituted aryl, or substituted or unsubstituted aralkyl.

* * * * *